US006374784B1

(12) United States Patent
Tischer et al.

(10) Patent No.: US 6,374,784 B1
(45) Date of Patent: Apr. 23, 2002

(54) VALVE CONTROL MECHANISM FOR INTAKE AND EXHAUST VALVES OF INTERNAL COMBUSTION ENGINES

(75) Inventors: Dieter Tischer, Wendlingen; Alfred Trzmiel, Grafenberg; Dieter Maisch, Riederich; Herbert Panowitz, Frickenhausen, all of (DE)

(73) Assignee: Hydraulik-Ring GmbH (DE)

( * ) Notice: Subject to any disclaimer, the term of this patent is extended or adjusted under 35 U.S.C. 154(b) by 0 days.

(21) Appl. No.: 09/441,652

(22) Filed: Nov. 12, 1999

(30) Foreign Application Priority Data

Nov. 12, 1998 (DE) ..... 198 52 209

(51) Int. Cl.[7] ..... F01L 9/02
(52) U.S. Cl. ..... 123/90.12; 123/90.11
(58) Field of Search ..... 123/90.11, 90.12, 123/90.15, 90.39, 90.41

(56) References Cited

U.S. PATENT DOCUMENTS

| | | | | | |
|---|---|---|---|---|---|
| 4,593,658 | A | * | 6/1986 | Moloney | 123/90.11 |
| 4,696,265 | A | * | 9/1987 | Nohira | 123/90.16 |
| 5,127,375 | A | * | 7/1992 | Bowman et al. | 123/90.12 |
| 5,152,260 | A | * | 10/1992 | Erickson et al. | 123/90.12 |
| 5,615,646 | A | * | 4/1997 | Feucht | 123/90.12 |

* cited by examiner

*Primary Examiner*—Weilun Lo
(74) *Attorney, Agent, or Firm*—R W Becker & Associates; R W Becker

(57) ABSTRACT

A valve control mechanism for intake and exhaust valves of internal combustion engines is provided. The valve control mechanism has at least one piezo element, at least one valve element operated thereby, and at least one adjustment piston. Inflow and outflow of a pressure medium to the adjustment piston is controlled by the valve element. The adjustment piston is moveable by the pressure medium, against a counter pressure, for opening an intake or exhaust valve.

46 Claims, 8 Drawing Sheets

VALVE CONTROL MECHANISM FOR INTAKE AND EXHAUST VALVES OF INTERNAL COMBUSTION ENGINES

BACKGROUND OF THE INVENTION

The invention relates to a valve control mechanism for intake and exhaust valves of internal combustion engines having at least one adjustment element with which the intake or exhaust valve is opened and closed.

In standard internal combustion engines, the control of the lifting movement of the intake and exhaust valves takes place through one of the crankshafts in a speed-ratio of 2:1 relative to the driven camshaft. The lifting curve of the valve is proportional to the curve of the cam for the entire sphere or reach of the performance graph and therewith unchangeable. The closing point of the intake valve is, conditional on the variable flow velocity in the exhaust pipe, not optimally situated. The intake valve's opening point, likewise, can also not be optimally situated. The data for the best possible (ideal) operating capacity of the combustion chamber at a high number of revolutions and of the cylinder-exhaust contents at a low number of revolutions and in idle are diametrically opposite. The opening point for the exhaust source is usually selected so that the exhaust release is minimized and the gas is in the position to perform the maximum amount of work.

Through avoidance of the aforementioned adjustments, there are always compromises, valve control mechanisms are developed, in order to be able to affect and change control-reaction time, stroke response of the intake/exhaust valves as a function of the engine speed, which load and other limiting qualities control and change. The operation of the valve lift can be affected or changed therewith through variation of the phase-relationship of the valve lift or the valve-opening time. Such measures can be used singly or in combination, on the one hand, in order to reduce fuel consumption and emissions of spark-ignition engines, while on the other hand, to improve the flow of the torque and to achieve the maximum power or output. A further advantage is the possibility that the sucked-in air mass can be affected by changing the cross-section of the valve opening, thereby making possible a choke-free load control without a throttle valve or flap.

Through multi-valve technology, such wiring can be undertaken, that the sucked-in load flows only over an intake valve, by which the air mass is affected. A cylinder shutoff, through the control of the intake/exhaust valve, likewise can be involved, whereby the fired cylinders can work most efficiently through the masking of the injection and combustion air. With modern engine electronics, the cylinder shutoff can be cyclically (selectively changed, in order to avoid the cooling-off of the cylinder wall.

The possibilities described above for controlling and altering of parameters are grouped together under the concept "variable valve control mechanisms." The manner of valve operation varies between direct and indirect operating systems.

With indirect operating systems, two solutions are known, namely the use of a variable camshaft or a variable intermediate element. With direct operating systems, basically three possibilities are known, which result in either a hydraulic, pneumatic or electric operation of the valve. A camshaft is not used in this situation.

In the hydraulic system, energy is saved, similar to a so-called Common Rail System and through fast-acting magnet valves or servo valves of the set piston surfaces, the energy is fed or discharged, by which the intake/exhaust valves are operated. Such systems are known for their use in long-running diesel engines.

The invention addresses the underlying problem of developing the type of valve control mechanism which operates simply and reliably at high switching frequencies, instead of an expensive servo valve, so that the valve control mechanism is also useful for high rotary internal combustion engines.

SUMMARY OF THE INVENTION

This problem is resolved by the type of valve mechanism with the specific charateristics of the invention namely, at least one piezo element; at least one valve element that is operated by said at least one piezo element; and at least one adjustment piston, wherein inflow and outflow of a pressure medium to the at least one adjustment piston is controlled by the at least one valve element, and wherein the at least one adjustment piston is moveable by the pressure medium, against the counter pressure for opening an intake or exhaust valve.

With the valve control mechanism which is the subject of this invention, a piezo electric actor is employed as an adjustment element. With this, a lightweight valve element is operated, which controls the inflow and outflow of the pressure medium to and from the adjustment piston, by whose lift the intake and exhaust valves of the internal combustion engine are opened and closed. Piezo electric actors convert electric voltage directly into movement and energy. The conversion of the electric input quantity into a mechanical output quantity occurs extremely quickly. By way of example, an adjustment lift of 40 $\mu$m (0.04 mm) can occur at a regulating time of 50 $\mu$s (0.00005 sec). The dissociation of the adjustment path, or movement, is possible in smaller electric currents of nanometers (0.0001 mm). Adjustment force is reached in kilo-newtons, that is to say, it acts as a correcting element with very high mechanical rigidity.

In the high-dynamic area, on the one hand, the availability of the suitable energy amplification is an essential prerequisite, in order to synchronize the current-running and the reaction of the intake and exhaust valves. On the other hand, the flow-through cross-section of the seating valve has to be adequately large in dimension. This results in an advantageous development of the valve control mechanism of the present invention by increasing the lift in value, for which the available adjustment movement of the piezo electric transformer does not suffice. Therefore, an adjustment-movement enlarger, or increaser, is used, which advantageously works by the principles of levers and which can increase the useable adjustment movement or action of the valve element, for example, to a factor of $v=10$.

With the valve control mechanism of the present invention, the opening and closing points of the intake and exhaust valves can be determined as required.

BRIEF DESCRIPTION OF THE DRAWINGS

Further characteristics of the invention are presented in the additional claims, the specification and the illustrations.

The invention is illustrated with the aid of the several embodiments shown in the accompanying figures.

DESCRIPTION OF PREFERRED EMBODIMENTS

With the aid of FIGS. 1 through 8, the various embodiments of the valve control mechanism in operation will be described. FIGS. 9 through 21 show concrete construction of such valve control mechanisms and their inherent characteristics.

The valve control mechanism described below makes possible high control frequency, so that this valve control mechanism also can be used with high rotary internal combustion engines.

Figure 1:
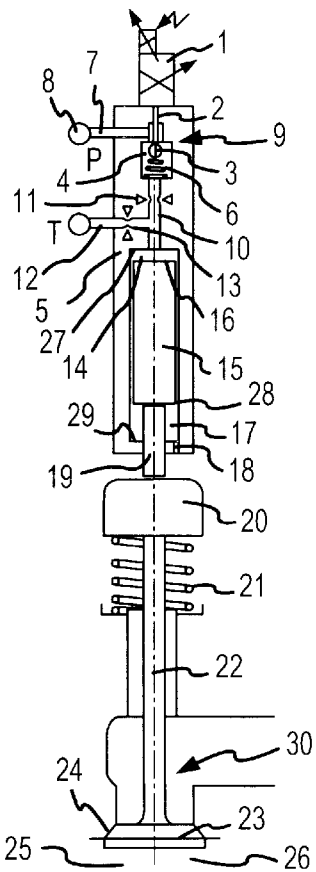

The valve control mechanism according to FIG. 1 has as an adjustment element a piezo element 1, whose stem or rod 2 bears upon a valve element 3 that is constructed as a ball valve. The valve element 3 is kept in place by the pressure of a compression spring 6, with which the valve element 3 is maintained in a closed position against a currentless or dead piezo element 1. Through pressure from the compression spring 6, which is preferably a tapered or cone-shaped spring, the valve element is pressed against the valve seating. In this closed position, the valve element 3 is fitted to a pressure line 7, through which the hydraulic medium is fed from a pressure source. The valve element 3 and the valve chamber 4 are part of a two-way acting (seating) valve 9, on which a feeder line 10 for hydraulic medium is connected. It is at least provided with a restrictor 11. A tank line 12, in which a restrictor 13 fits, opens into the feeder line 10. The feed line 10 connects the valve chamber 4 with a surge chamber 14, which is provided in the valve housing 5 and in which an set piston 15 is found, and whose front surface 16 is acted upon by hydraulic medium. On the opposite side of the surge chamber 14 is found a cylinder space or area 17, which has an opening 18 leading to or connected to the atmosphere. A push rod or plunger 19 projects into the cylinder space, which interacts or cooperates with a cupping rod 20. It is maintained under the pressure of a compression spring 21, which via a valve stem or shaft 22 of the cupping rod 20 and the bolt-shaped rod or plunger 19 isloaded therewith in the direction of the set piston 15 (see also FIG. 9). The valve stem or shaft 22 fits against the cupping rod 22, which is provided with a valve head or spring cap 23 at its free end. With this, an inlet or outlet opening 24 of an internal combustion chamber 25 of an internal combustion engine 26 of a motor vehicle is opened or closed.

If the piezo element 1 is again currentless or dead, the valve element 3 will be returned to its closed position illustrated in FIG. 1 from the force of the spring 6. By this, the pressure medium-supply from the line 7 to the surge room 14 will be closed or blocked, and the compression spring 21 can now displace the cupping rod 20 and the stem or rod 19 again the set piston 15 and this in the direction of the two-way seating valve 9. In this manner, the recovered pressure medium in the surge chamber 14 is displaced over the line 10, the pressure regulating valve 13 and the line 12 to the tank. When the set piston 15 is returned to its starting position illustrated in FIG. 1, the valve head 23 closes the intake/exhaust opening 24 of the combustion chamber 25.

The piezo element 1 can be driven at very high frequencies, so that the described opening and closing operation of the intake/exhaust valve 30 can take place at the required high control frequency. The valve control mechanism is therefore suitable for internal combustion engines which run at high speeds. In the described manner, similar valves 30 of an internal combustion engine 26 can be operated.

The intake/exhaust valve 30 is maintained in the open position and in the closed position, respectively, over a period of time as described above. In this manner, here are four cyclical, repeating working phases for the intake/exhaust valve 30, namely, opening, held-open, closing, and held-closed.

Figure 9:
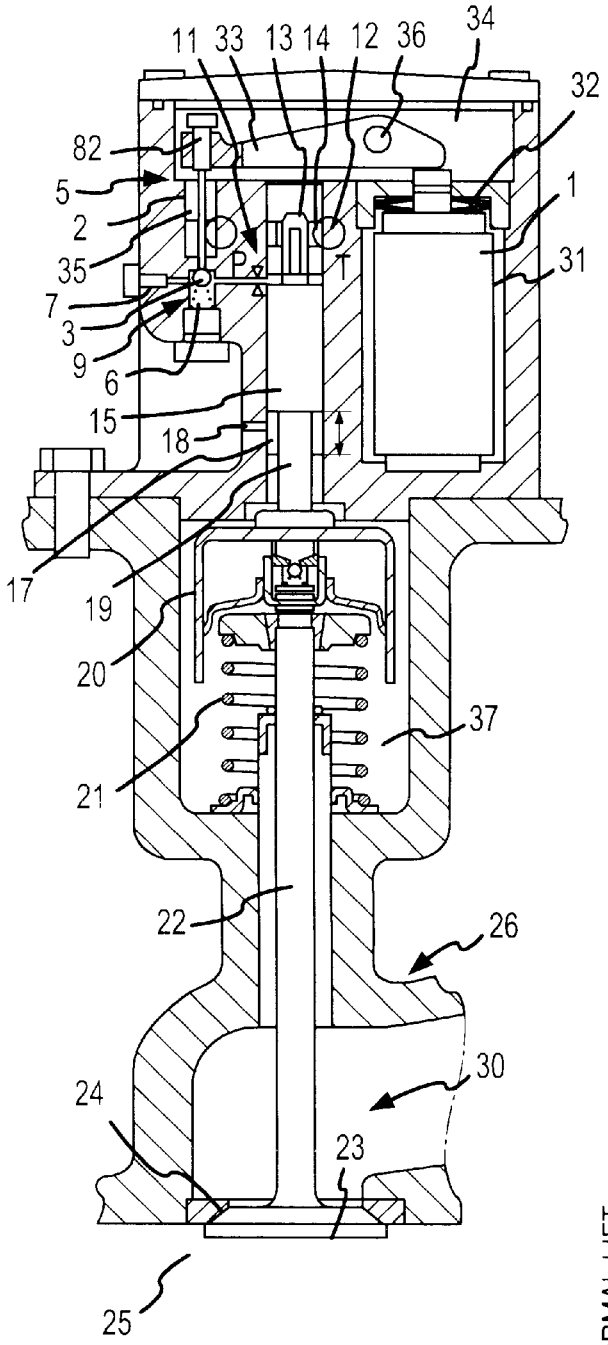
FIG. 9 shows a cut through a valve control mechanism with the working principles corresponding to FIG. 1, in this case with an additional lift transmitter.

FIG. 9 illustrates a concrete application of the embodiment shown in FIG. 1. The piezo element 1 fits in the valve housing 5 hear the set piston 15 and the valve element 3. The piezo element 1 fits in a receiving area 31 of the valve housing 5 and is tensioned in the receiving area 31 through springs 32, specifically through plate springs. The piezo element 1 works together with one of a two-armed lever 33, which is pivotally supported in a housing area 34. One lever arm works together with the piezo element, while the other lever arm acts upon the valve element 3 through the operation of the stem or rod 2 on a set screw 82. With them, the lift positions of the piezo element 1 and the stem or rod 2 have concerted, or cooperating, action. The stem or rod 2 is guided through a pivot, so that it can be reliably shifted.

The set piston 15 is found in the area between the two-way seating valve 9 and the piezo element 1. If the piezo element 1 is charged and therefore elongated, the lever 33 will be swung in a counterclockwise direction around its vertical axis toward the horizontal axis of the piezo element 1. In this manner, the stem or rod 2 is shifted downwards, whereby the valve element 3 is shifted into the open position by the force of the compression spring 6. The pressure line 7 is opened, so that the pressurized hydraulic medium can flow over the restrictor 11 in the surge chamber 14. The set piston 15 is thereby shifted downwards. The valve shaft 22 is shifted via the rod or plunger 19 and the cupping rod 20 under the force of the compression spring 21, so that the valve head 23 is raised or lifted from the valve seating and the intake/exhaust opening 24 in the internal combustion chamber 25 is released. In this open position the piezo element remains charged. In this static operation, a nearly powerless retention of the driven position of the set piston 15 is possible. As soon as the piezo element is again currentless or dead and thereby shortened, the valve element 3 is moved by means of the pressure spring 6 to its closed position and the connection from the pressure line 7 to the surge chamber 14 is broken. The surge chamber 14 is now only connected to the tank by the restrictor 13. The lever 33 is swung or pivoted in a counterclockwise direction around the axis 36 over the rod 2. The pivoting movement ends with the closing of the valve element 3. The valve shaft 22 is shifted upwards by the pressure spring 21, whereby the piston 15 is shifted upward via the cupping rod 20 and the rod 19. The hydraulic medium found in the surge chamber 14 is expelled or driven out to the tank through the restrictor 13 and the tank line 12 in the described manner. In this closed position, the piezo element remains uncharged in accordance with engine management.

The cupping rod 20 is found in an intake area 37 of the internal combustion engine 26. The valve housing 5 is fastened to the internal combustion engine 26. The intake area 37 is closed by the valve housing 5.

In that the piezo element 1 is arranged in the area near the two-way seating valve 9 and the set piston 15, the valve housing 5 has only a small height. Because of this, the set piston 15 also is arranged in the area near the two-way seating valve 9. The lever 33 serves as a transmission lever, which transmits the very small course of the piezo element 1 over the lengthened lever arm in a sufficiently large displacement course of the rod 2.

Figure 9A:
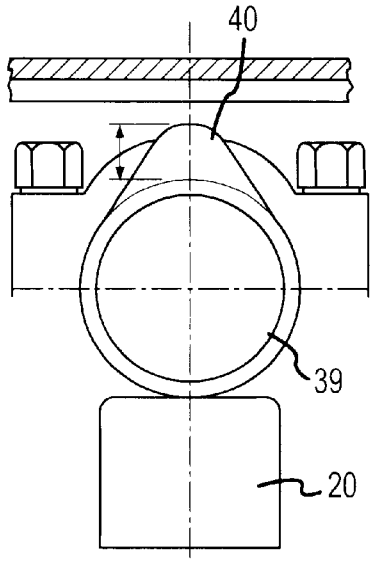
FIG. 9*a* shows in a simplified representation a portion of a common camshaft drive (without representation of a rocker arm)

FIG. 9*a* shows a customary valve control mechanism using a camshaft. A rocker arm which fits between the camshaft 39 and the cupping rod 20 is not clearly represented. The cam 40 of the camshaft 39 works together with the cupping rod 20 of the intake/exhaust valve in the known manner. The lift of the valve shaft 22 by means of the cam 40 has the same magnitude as the valve control mechanism described with reference to FIGS. 1 and 9.

Figure 9B:
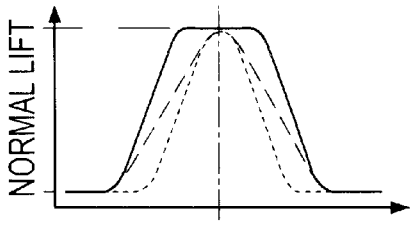
FIGS. 9*b* and 9*c* show in two diagrams the lift of a valve of an internal combustion engine dependent on time, from use of the valve control mechanism of the present invention.
Figure 9C:
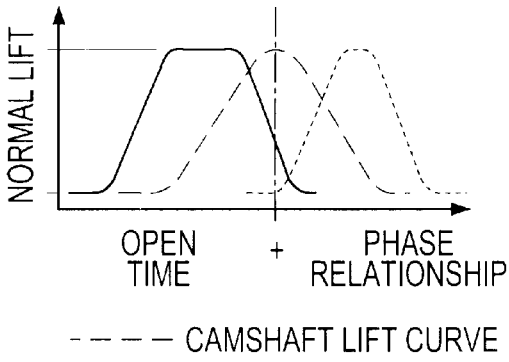

FIG. 9*b* shows with solid lines, that with the valve control mechanism having no camshaft, the intake/exhaust vale 30 can be opened and closed more quickly than with the customary camshaft control mechanism (dotted lines in FIG. 9*b*). The dotted lines represent the possibility of varying the opening time of the intake/exhaust valve 30 with the valve control mechanism having no camshaft. FIG. 9*c* shows the possibility of varying the phase relationship (solid and dotted lines), and thereby also the opening time (dotted lines), with the valve control mechanism having no camshaft.

Figure 2:
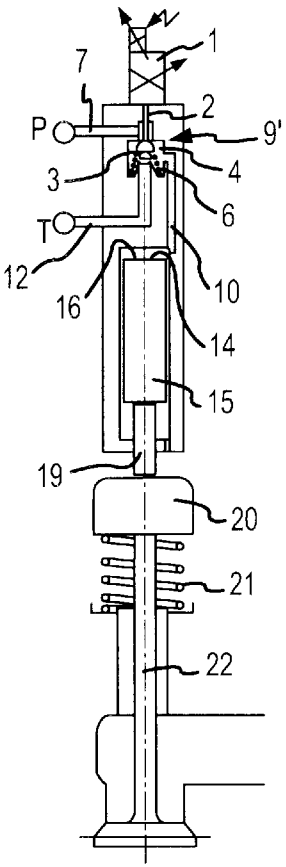
Figure 10:
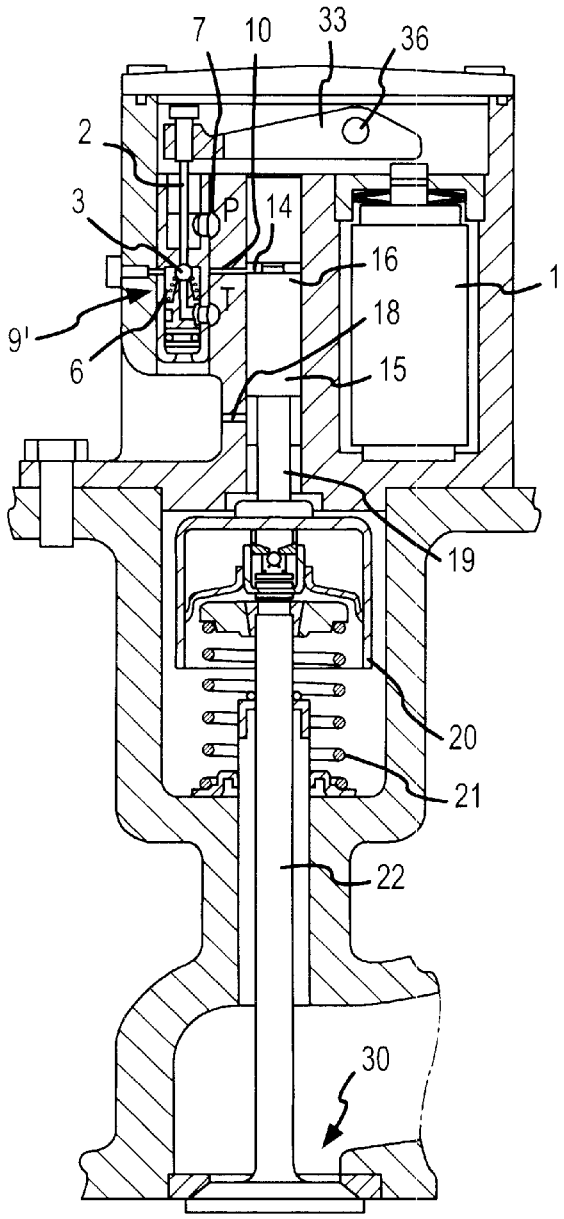
FIG. 10 shows in axial cutaway a valve control mechanism of the present invention with the working principles of FIG.2, in this case with an additional lift transmitter.
Figure 11:
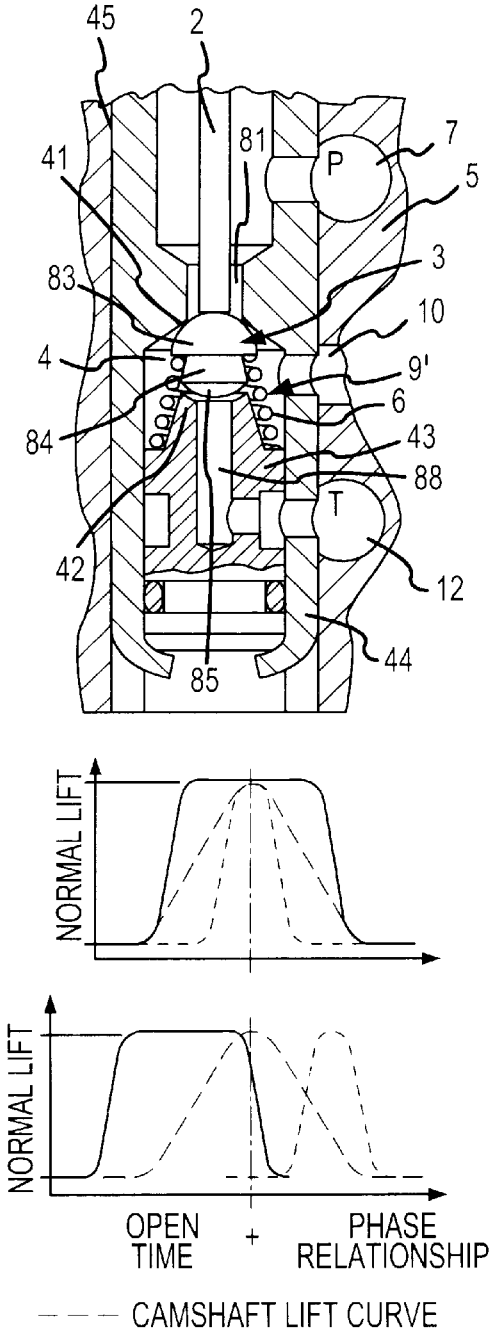
FIG. 11 shows in enlarged representation a portion of the valve control mechanism of FIG. 10.

FIGS. 2 and 10 show a valve control mechanism, which, like the preferred embodiment of FIGS. 1 and 9, runs at a higher control frequency. The valve 9' is different from the foregoing embodiment by having a three-way valve with two seats. FIG. 2 shows again the situation of a currentless piezo element 1. The valve element rests, under the force of a compression spring 6, on an upper valve seating 41 (FIG. 11). Unlike the preferred embodiment, the tank line 12 empties in a lower valve seating 42 of the three-way valve 9'. FIG. 11 shows the three-way valve of FIG. 10 in an enlarged representation.

Upon opening of the intake/exhaust valve 30, the piezo element 1 is charged and is thereby enlarged. The two-armed lever 33 is thereby swung around the axis 36 in a counterclockwise direction, whereby the rod 2 is displaced under the force of the compression spring 6, until it fits tightly on the other valve seating 42. By this process, the tank line 12 is closed, so that the charged medium flowing through the pressure line 7, with the exception of the supply line, arrives in the surge chamber 14. By this process, the front face 16 of the set piston 15 is loaded with pressure medium, so that it is shifted below in the described manner and displaces against the rod 19 and the cupping rod 20 of the valve shaft 22. In this way, the intake/exhaust valve 30 is opened in the described manner and in case of need, is maintained in an opened position.

Upon closing of the intake/exhaust vale 30, the piezo element 1 is switched to currentless and shortens itself to its unsprung length. The valve element 3 is shifted by the compression spring 6 to the higher valve seating 41, whereby the pressure line is closed and the tank line is opened. In this manner, the hydraulic medium can be emptied out of the surge chamber 14 through the supply line 10 in the tank line 12. Through the release of pressure from the surge chamber 14, the intake/exhaust vale 30 is closed in the previously described manner and in case of need, is maintained in a closed position.

The lower valve seating 42 of the three-way valve 9' is provided with an insert 43 (FIG. 11), that is held in a wider insert. It is pressed in a mounting area 45 of the valve housing 5. The free end of the insert 44 is inwardly flanged, whereby the insert 44 is held in place.

The three-way valve 9' constitutes a changeover valve. The valve element 3 accordingly has two valve portions 83 and 85, with which it alternately fits closely on the higher valve seating 41 and the lower valve seating 42. The higher seating portion 83 is constructed in partial ball shape in the illustrated preferred embodiment but can also have a conical shape. The valve portion 83 has somewhat of a half-ball shape. On the valve portion 83, a shoulder is connected, on which the compression spring 6 by its upper end is suspended. The shoulder 84 widens itself into a conical shape from the upper valve portion 83. In the transition from the shoulder 84 in the upper valve portion, a step or ridge is formed. The difference in diameter between the shoulder 84 and the valve portion 83 corresponds to the doubled wire gauge of the compression spring 6. In this manner, the upper end of the compression spring does not protrude radially across the valve portion 83. If the shoulder 84 is constructed in a conical shape, the compression spring 6 also has a conical shape. The upper end area of the compression spring 6 fits against the wall or surface of the shoulder 84. If the shoulder 84 and the compression spring 6 are constructed in a conical shape and are widened out from the valve portion 83, an axial safety mechanism is given for the compression spring 6 on the shoulder 84. In this manner, the assembly of this valve 9' is facilitated. The lower valve portion 85 is again partly ball-shaped I construction and has a maximum diameter that corresponds to the maximum diameter of the shoulder 84. The valve portion 85 can also be constructed in a conical shape. The greater diameter of the shoulder 84, or as the case may be, the lower valve portion 85, is smaller than the greater diameter of the upper valve portion 83. Accordingly, the lower valve portion 85 has a smaller valve diameter than the upper valve portion 83, so that the upper valve seating 41 has a greater diameter than the lower valve seating 42. The upper valve seating 41 is traversed axially by the rod 2. The resulting annular area 81 (FIG. 11) of the upper valve seating 41 is approximately coextensive as the circular area 88 of the lower salve seating 42. The valve element 3 is cost-effective if constructed in a ball-shape. In this situation, the upper and lower valve portions 83, 85 have a common center of curvature.

The remainder of the valve control mechanism of FIGS. 2, 10, and 11 is similar in construction as the foregoing embodiments (FIGS. 1 and 9). The intake/outlet valve still can be opened and closed quickly with this valve control mechanism, as the corresponding diagrams under FIG. 11 illustrate (solid and doted lines). The closing and opening times of the standard camshaft valve control mechanism are similarly represented with dotted lines. The phase relationship and the opening duration in a similar manner can be varied, as illustrated in FIGS. 9*b* and 9*c*.

Figure 3:
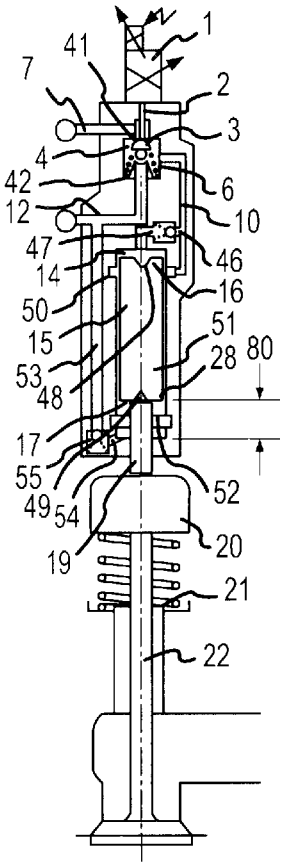
FIGS. 1 through 3 shows in schematic representation various embodiments of the valve control mechanism of the present invention, which work with constant lift.
Figure 12:
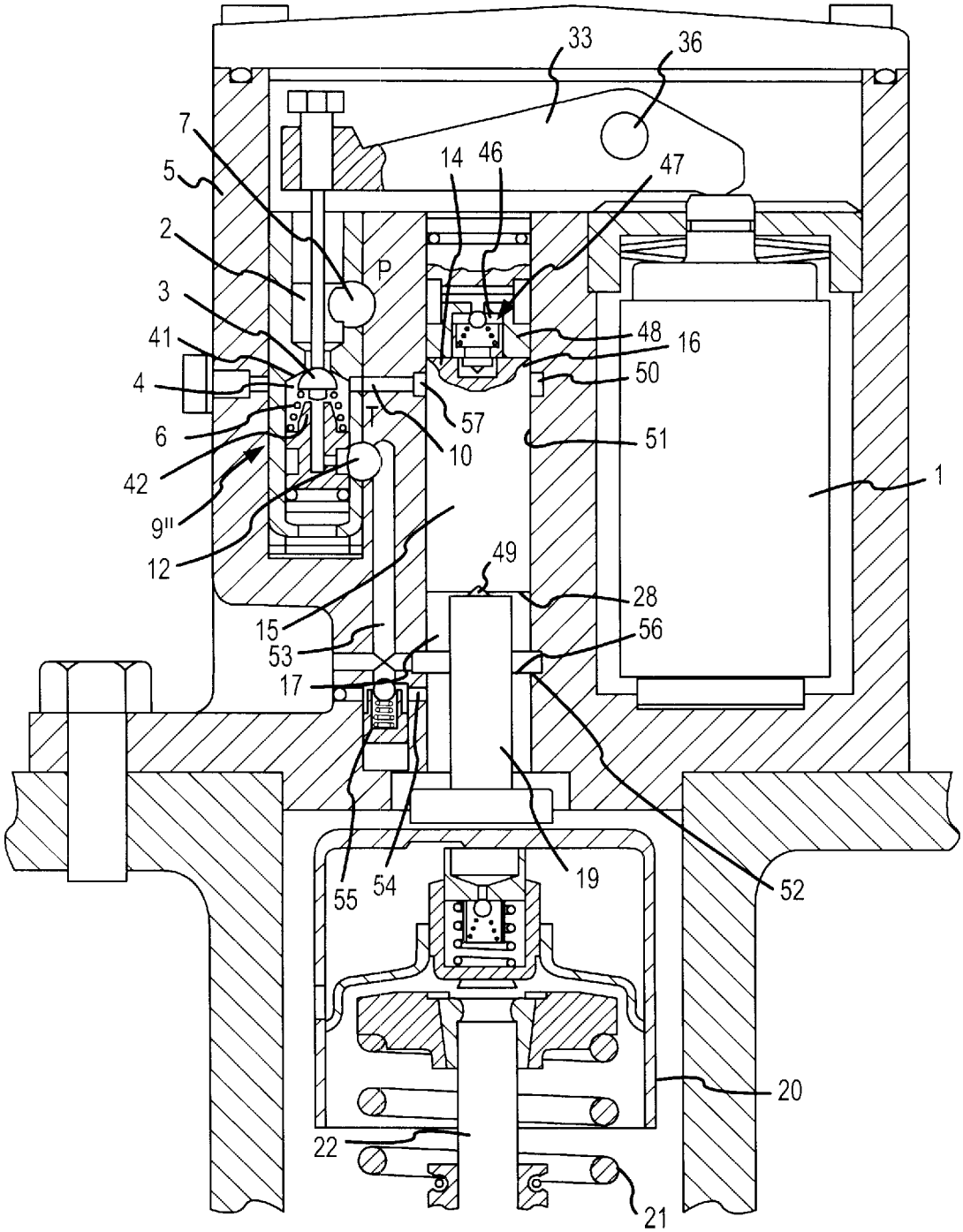
FIG. 12 shows in axial cutaway a valve control mechanism of the present invention with the working principles of FIG. 3, in this case with an additional lift transmitter.
Figure 13:
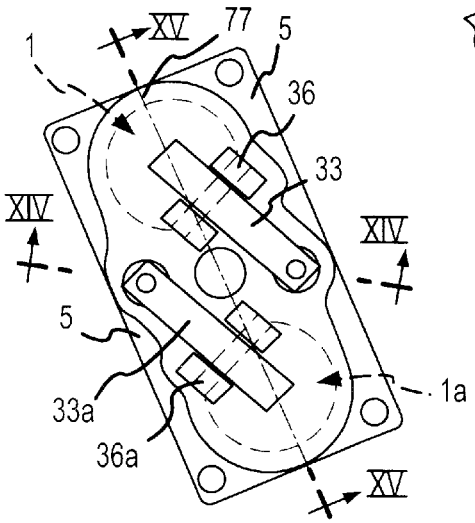
FIG. 13 shows a plan view of a valve control mechanism of the present invention with the working principles of FIG. 6, in this case with an additional lift transmitter.

FIGS. 3 and 12 show a valve control mechanism with damping of the end position of the set piston 15. The valve control mechanism has the piezo element 1, with which the rod 2, through operation of the valve element in the described manner, is displaced or shifted. As shown in FIG. 12, the connection between the piezo element 1 and the rod 2 again is a result of the two-armed lever 33, with which, on charging of the piezo element 1, the rod is displaced or shifted and the valve element 3 accordingly shifts. The valve 9" is constructed as a three-way valve with two valve seatings, as described with reference to previous embodiments (FIG. 11). When the piezo element 1 is not charged, the valve element 3 is fitted snugly against the upper valve seating 41 under the force of the compression spring 5. The pressure line 7 is thereby separated from the supply line 10. When the piezo element 1 is charged, the lever 33 is pivoted about its axis in a counterclockwise direction, whereby the rod 2 is displaced, or shifted, and the valve element 3 is lifted from the upper valve seating 41, until it is lies on the other valve seating 42. The hydraulic medium can thereby arrive at the supply line 10 from the pressure line 7 through the valve chamber 4. From the supply line 10, a shunt line 46 branches off, in which an open check valve sits in the direction of the set piston 15. The shunt line 46 empties in the surge chamber 14.

The front face or surface 16 of the set piston 15 is provided with a choke cross-section 48, which is diametrical in the preferred embodiment and which, in cross section, is constructed as a three-corner recess. Also, the opposite front face or surface 28 of the set piston 15 is provided with a choke cross section 49, which, likewise, preferably is constructed, in cross section, as a three-corner, diametric recess. As in the previous embodiments, the front surface or face 28 of the set piston 15 is fitted against the rod 19, which, like the previously described embodiments, has a smaller cross-section than the front face or surface 28 or the set piston 15. The cupping rod 20 and the valve shaft 22 are shifted across the rod 19, in the manner described.

The supply line 10 empties in an annular channel 50, which is provided in the wall of a piston space or chamber 51. A wider annular channel 52 in the wall of the piston space or chamber 51 is provided in the cylinder area or chamber 17. This annular channel 52 is connected to the tank line 12 by a return line 53. The cylinder space or chamber 17 is connected to a return line 55 by a shunt line 54, the return line 55 separating the shunt line 54 from the return line 53 and which opens in the direction of the shunt line 54.

Upon the opening of the intake/exhaust valve 30, the piezo element 1 becomes charged. The rod 2 will be shifted across the lever 33, whereby the valve element 3 is lifted from the seating 41 and is brought to rest on the opposite valve seating 42. In this manner, the pressure line 7 is opened, so that the hydraulic medium can flow across the valve chamber 4, the supply line 10, the transverse borehole 46 and the return valve 47 in the surge chamber 14. When the valve element 3 lies against the valve seating 42, the connection to the tank line will be closed. The hydraulic medium arrives at the annular channel 50 through the supply line 10, the annular channel 50 closed by the set piston 15 next. The set piston 15 is shifted below by the hydraulic medium in the surge chamber 14. In contrast to both previous embodiments, hydraulic medium is found in a lower cylinder space or chamber 17. It is emptied into the tank line 12 by means of the shifting or displacement of the set piston 15 across the annular channel 52 and the return line 53. The front face or surface 38 is found next to, but spaced from, the annular channel 52. Passage of the set piston with its front faces or surface 28 to the leading edge 57 of the annular channel 52, the choke cross-section 49 in the front face 28 begins working together with the annular channel 52. As the recess 49 in the direction of the front face 28 continuously enlarges, the downward motion of the set piston 15 accedes toward the passage of the leading edge of the annular channel 5. Due to the increasingly smaller choke cross-section and the closed return valve 55 a throttle effect is created, which leads to a damping effect from the downward motion of the set piston 15. As a result of the continual narrowing of the cross section of passage for the hydraulic medium, a pressure in the medium in the cylinder space or chamber 17 is built up, which works against the downward motion of the set piston 15 and so the damping effect is brought about through the reduction of speed. The return valve 55, which is connected to the cylinder space or chamber 17 by the shunt line 54, closes against the return line 53 and therefore the tank line 12.

To close the intake/exhaust valve 30, the piezo element 1 is again rendered currentless and thereby shortened. The valve element 3 is shifted or displaced from the valve seating 42 by the compression spring 6 in the described manner and pressed against the valve seating 41. In this manner, the pressure line 7 is closed off from the supply line 10. Likewise, the valve shaft 22 and the cupping rod 20 are shifted or displaced by means of the compression spring 21. The set piston 15 is carried along by the rod 19. The set piston 15 empties the hydraulic medium from the surge chamber 14 into the annular channel 50, through which the hydraulic medium flows, via the valve chamber 4, into the tank line 12. As soon as the front face of the set piston 16 passes over the leading edge 57 (FIG. 12) of the annular channel 50, the choke cross-section in the set piston's front face 15 comes into a working relationship with the leading edge 57 of the annular channel 50. With an increasing upstroke, the choke cross-section of the flow of the hydraulic medium in the annular chamber is continually minimized, whereby a pressure is built up in the surge chamber 14. This pressure works against the downward motion of the set piston 15 and produces the damping effect. The return valve 47 impedes the flow of the hydraulic medium, caused by the upstroke of the set piston 15, from the surge chamber 14 into the supply line 10.

The described embodiments preferably show that the set piston 15 in both end positions is damped, or attenuated. In this manner, this valve control mechanism works very quietly. The remainder of the three-way valve 9" is constructed similarly to the previous embodiments. Also, with this valve control mechanism, the three-way valve 9", the set piston 15, and the piezo element 1 lie near one another in a space relationship in the valve housing 5. The valve housing 5 has therefore only a smaller or minor, height.

As FIGS. 1 through 3 show schematically, it is also possible to operate the rod 2 directly through the piezo element 1, so that a transmission lever 33 is inapplicable. The input of a transmission lever has the advantage that the lift of the valve element can be enlarged in a transformation ratio. In this manner, different flow passage cross-sections can be achieved.

Figure 5:
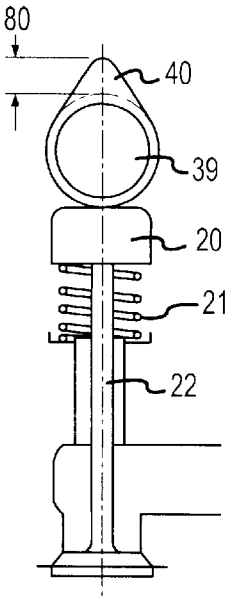
FIG. 5 shows in schematic representation a valve control mechanism which employs a camshaft (without representation of a rocker arm) in the state of the technology.

As FIGS. 3 and 5 similarly show, the same lift 80 is obtained with the valve control mechanism shown in FIGS. 1 through 3, or, as the case may be, in FIGS. 9 through 12, as the application of a standard cam shaft control mechanism (FIG. 5). Consequently, the valve control mechanism having no camshaft can be used instead of the valve control mechanism which does employ a camshaft.

Figure 4:
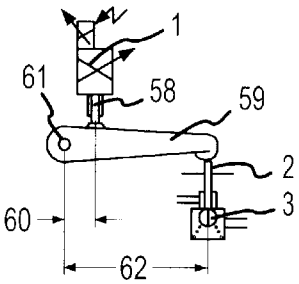
FIG. 4 shows in schematic representation the assembly of a lift transmitter between a piezo element and a seating valve in accordance with the valve control mechanism of the present invention.

FIG. 4 shows schematically the possibility that the piezo element 1 through a rod 58 can work together with a one-armed transmission lever 59. The rod 58 acts at a distance from the axis of rotation of he lever 59. The free end of the lever 59 acts upon the rod 2, by which the valve element 3 is shifted or displaced in the described manner. The free end of the lever is at a distance 62 from the axis of rotation 61. Over both distances 60, 62 the desired transformation ratio is determined.

In the above-described manner, the lift of the set piston, and therefore the lift of the intake/exhaust valve 30 is unchangeable.

FIGS. 6 and 13 through 21 shown an embodiment, in which this valve life can be changed. The valve control mechanism has two piezo elements 1, 1*a*, which operate with two rods 2, 2*a*, in order to displace or shift two valve elements 3, 3*a* to two seating valve 9, 9*a*. Both valve elements 3, 3*a* are maintained under the force of at least one compression spring 6, 6*a*. The pressure line 7 empties into the valve chamber 4*a* of seating valve 9*a*. With a currentless piezo element 1*a*, the pressure line 7 is separated from the supply line 10, which empties into the surge chamber 14, by the closed valve element 3*a*. From the supply line 10, a connecting line 63 branches off, which empties into the valve chamber 4 of seating valve 9. In the case of an uncharged piezo element 1, the valve chamber 4 is connected to the tank line 12.

Figure 6:
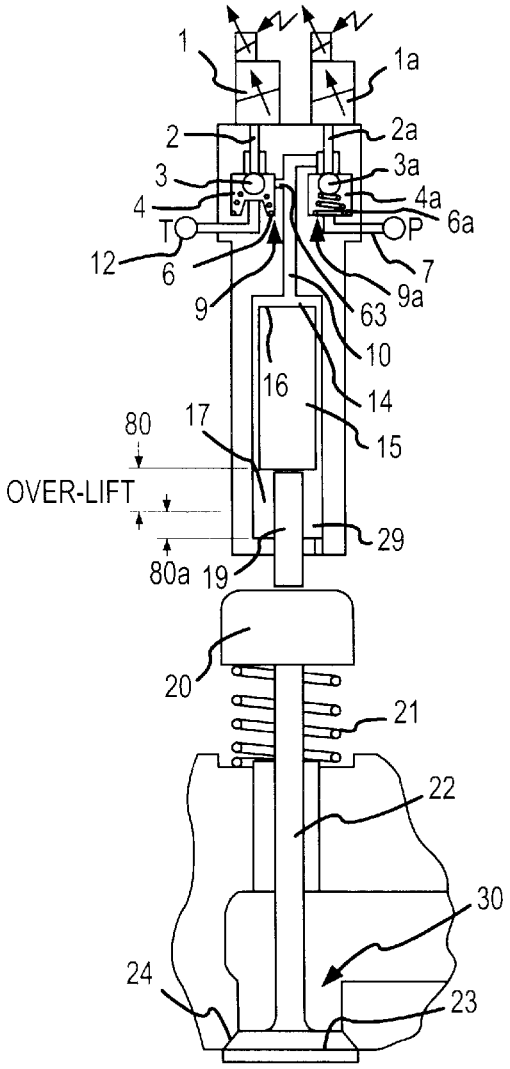
FIGS. 6 through 8 show in schematic representation further embodiments of the valve control mechanism of the present invention, which work with variable lift.

FIG. 6 shows the situation in which both piezo elements 1, 1 are currentless, and therefore, the intake/exhaust valve 30 is closed. Should the intake/exhaust valve 30 reach the maximum opening lift (normal lift and over-lift), the piezo elements 1, 1 will become charged. In this manner, both rods 2, 2*a* are shifted. The valve element 3 is moved by the rod 2 through the pressure of the spring 6 into its closed position, which closes the tank line 12. With the rod 2*a*, the valve element 3*a* is moved into an open position, so that the hydraulic medium, through the pressure line 7 and the valve chamber 4*a*, can flow into the supply line 10. In this manner, the hydraulic medium arrives in the surge chamber 14 and displaces the set piston below. The valve shaft 22 is shifted across the rod 19 and the cupping rod 20 and in this manner, the intake/exhaust valve 30 is opened. The set piston 15 is shifted until it comes to rest on the floor of the cylinder area or chamber 17. Therefore, the lift of the set piston 15, and therefore the valve 30, corresponds to the normal lift plus an over-lift.

If the principles of engine management are followed, the set piston 15, and therefore also the valve 30, can be adjusted merely to the normal, or to other desired, lifts. Hereunto, both piezo elements 1, 1*a* will become charged and the piezo element 1*a*, after a specified time of lift, will be made currentless, so that the valve element 3*a*, by the force of the compression spring 6*a*, is moved into its closed position. In this manner, the pressure line is separated from the supply line 10. Concurrently, the piezo element 1 remains charged and, in this manner, the valve 3 is closed and the volume in the surge chamber 14 enclosed. Similarly to the previous examples, smaller fluid volume of the hydraulic medium flowed into the surge chamber determines the lift of the set piston 15, and therefore also the lift of the intake/exhaust valve 30, as the piezo element 1 again becomes charged and, in this manner, the line 63 to the tank 12 remains closed. The fluid volume found in the surge chamber 14 remains therefore enclosed, the valve 30 is opened a little wider, so that the a correspondingly smaller volume of a fuel-air mixture is received in the internal combustion chamber of the internal combustion engine.

Should the intake/exhaust valve 30 be closed, the piezo element 1 is switched to its currentless state. The compression spring 6 lifts the valve element 3 from his valve seating 66, whereby the hydraulic medium found in the surge chamber 14 can be displaced through the supply line 10 and the opened valve chamber 4 into the tank line 12.

Figure 17:
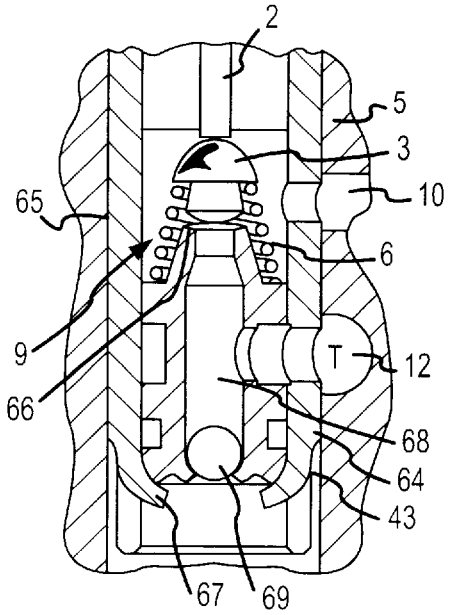
FIGS. 16 and 17 show, respectively, in enlarged representation a portion of the valve control mechanism of FIG. 14.
Figure 16:
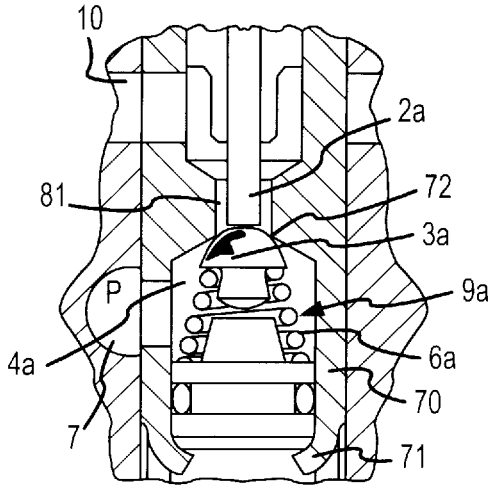

As FIGS. 16 and 17 show, the valve element 3 and the compression spring 6 line in a sleeve or bushing 64, that is fitted into a mounting space 65 of the valve housing 5. The valve seating 66 provided for the valve element 3 is provided with an insert 43, that is constructed substantially similar that shown in the embodiments of FIG. 10 and 11. The compression spring 6 maintains the valve element 3 in the open position by means of an uncharged piezo element 1, as is shown in FIG. 17. The insert 43 is axially secured to the unflanged end 67 of the sleeve or bushing 64. A central axial borehole 68 of the insert 43 is closed by a locking member 69, preferably a ball.

The valve element 3*a*, likewise, is incorporated in a sleeve or bushing 70 (FIG. 16), whose lower end 71 is unflanged. The valve element 3*a* is pressed upwardly against the valve seating 72 by the compression spring 6*a*. The rod 2*a* axially penetrates the valve seating 72 and therewith, creates the requisite annular surface for the flow.

Both seating valves 9, 9*a* lie on both sides of the set piston 15 and axis-parallel to it. In this manner, the valve housing 5 has only a minimal height.

Figure 14:
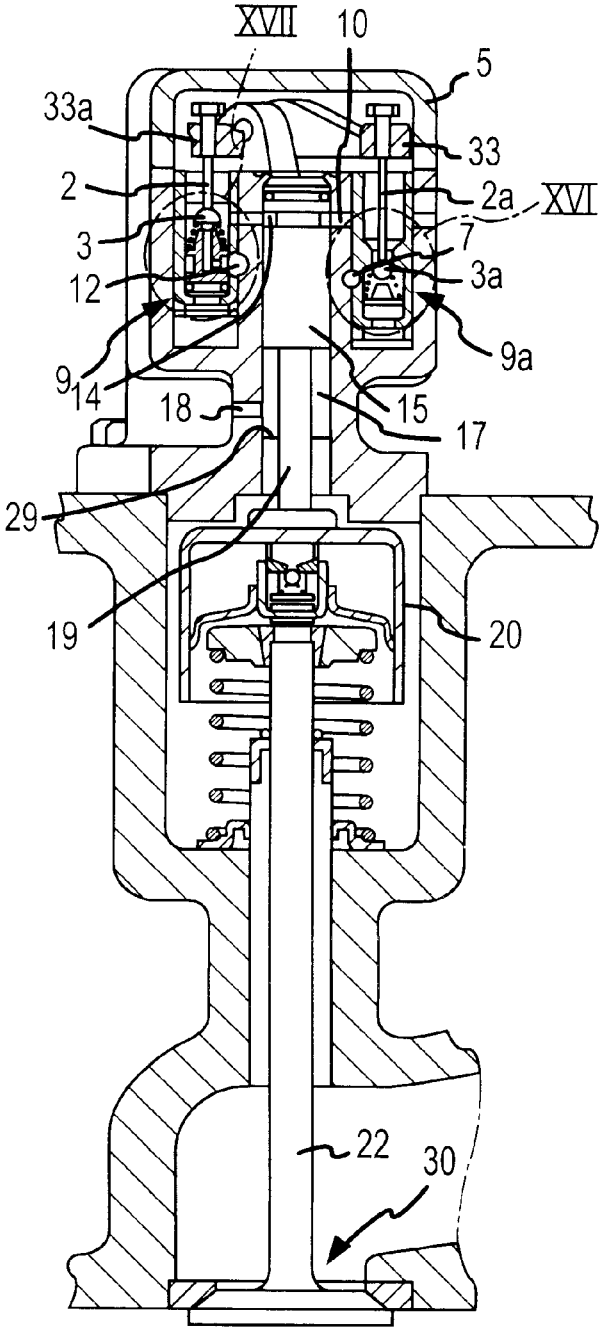
FIG. 14 shows a cut along the lines XIV—XIV in FIG. 13.
Figure 14:
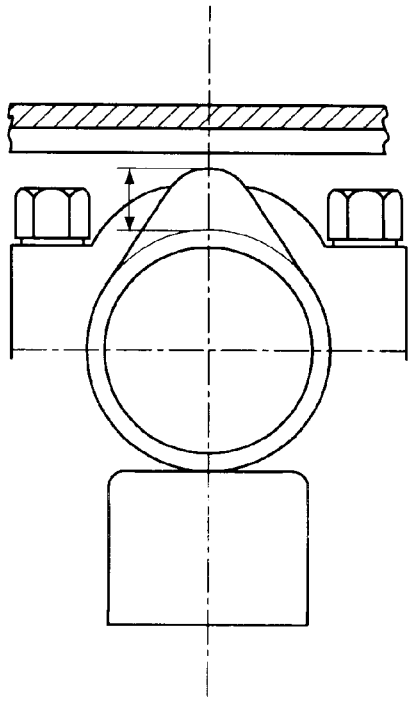

The cylinder chamber or area 17 is, as FIG. 14 shown, is connected to the atmosphere by a ventilation line 18, so that the set piston 15 can be reliably shifted upon opening of the intake/exhaust valve 30.

To open the intake/exhaust valve 30, both piezo elements 1, 1*a* become charged. The magnitude of the lift of the set piston 15, and therewith of the intake/exhaust valve 30, depends on this, after which time as the opening of the intake/exhaust valve 30 begins, the piezo element 1*a* is no longer charge and therefore hydraulic medium can no longer flow into the surge chamber 14. In dependence on the charged state of the piezo element 1*a*, the lift of the intake/exhaust valve 30 can thereby be infinitely regulated or controlled.

For the closing movement of the intake/exhaust valve 30, a damper is to be provided, as illustrated by FIGS. 3 and 12. The damper is, in this instance, similarly constructed as that shown in these embodiments.

With the described embodiments, the phase relationships of the opening and closing, respectively, of the intake/exhaust valve 30 can be changed, in contrast to a camshaft mechanism. It is therefore possible make the intake/exhaust valve 30-associated piezo elements charged or uncharged at the desired point in time. As described with reference to the embodiments shown in FIGS. 6 and 13 through 17, the magnitude of the opening lift of the intake/exhaust valve 30 can also be varied.

Figure 18:
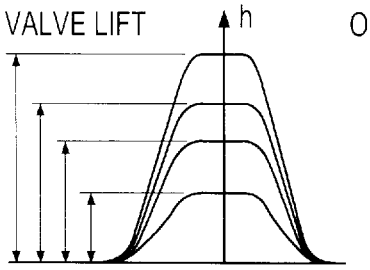
FIGS. 18 through 21 show various diagrams, which represent the possibilities for variation of the valve lift, the opening time duration, the phase relationship and the combination of these parameters.

FIG. 18 shows lift characteristic curves of the described possibilities, by means of the embodiments of FIGS. 4 and 14 through 17, for varying the opening lift of the intake/exhaust valve 30.

Figure 19:
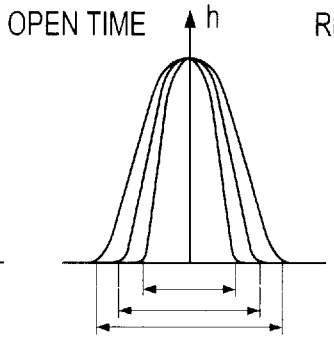
Figure 20:
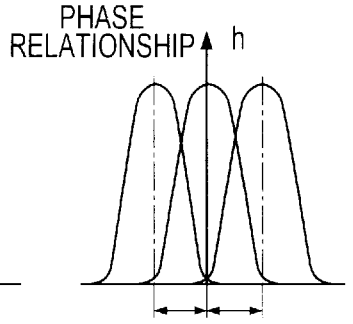
Figure 21:
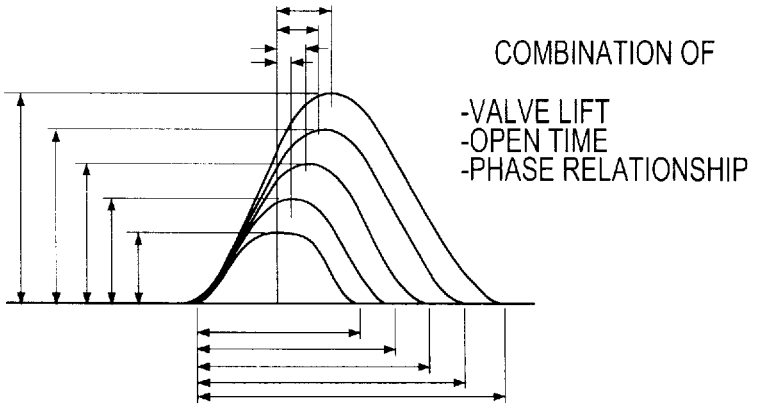

FIG. 19 illustrates, by means of curves, that the opening time duration of the intake/exhaust valve 30 can be changed in the described manner. From the curves in FIG. 20, it follows that, additionally, also the phase relationships can be adjusted in the described manner. FIG. 21 finally illustrated the curve for the embodiment of FIGS. 6 and 13 through 17, in which the three adjustment possibilities shown in FIGS. 18 through 20 can be used in combination. The valve lift, the opening time duration and the phase relationship can thereby be changed. This embodiment represents a wholly variable control of the intake/exhaust valve 30.

Figure 7:
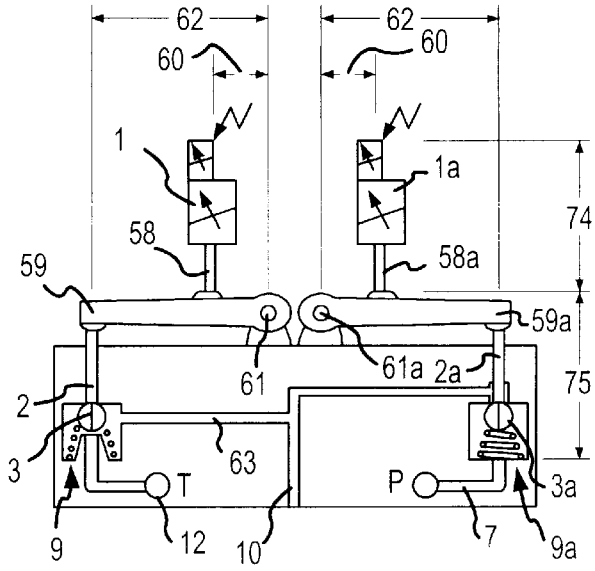

The rods 2, 2*a* can be directly operated by the piezo elements 1, 1*a*, as is schematically represented in FIG. 6. However, it is also possible to provide a transmission lever 59 between the rod 2, 2*a* and the piezo element 1, 1*a*, respectively, in order to enlarge the opening and closing lift of the valve element 3, 3*a* with the default piezo lift. As schematically represented in the embodiment of FIG. 7, the transmission lever 59, 59*a* is a one-armed lever. The rod 59, 59*a* acts on it at a distance 60 from the axis of rotation 61, 61*a* of the lever 59, 59*a*, according to the embodiment shown in FIG. 4. The rod 2, 2*a* acts upon the free end of the lever 59, 59*a*, which is found at a distance 62 from the respective axis of rotation 61, 62. As in the embodiment of FIG. 4, the rods 2, 58 and 2*a*, 58*a* lie on opposite sides of the lever 59, 59*a*. By the ration of the distances 60, 62 to one another, the transmission arm can be determined.

Figure 8:
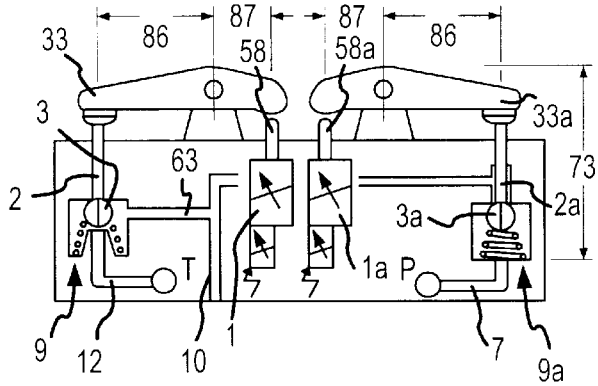

As in the embodiment of FIG. 8, where the lever 33, 33*a* is a two-armed lever, the lever arms 86, 87 are of different lengths. The rods 58, 58*a* of piezo elements 1, 1*a* act upon the shorter arm 87. On the same side as the lever 33, 33*a*, the rods 2, 2*a* act upon the free end of the longer lever arm 86. By the ratio of the length of the lever arms to one another, the transmission ratio can likewise be determined.

As with the embodiment of FIG. 8, both rods 2, 58 and 2*a*, 58*a* lie on the same side of the lever 33, 33*a*, resulting in a smaller height 73. As with the embodiment of FIGS. 13 through 17 individually show, the two-armed levers 33, 33*a* lie spatially offset from one another, so that the valve housing 5 only has adequately minimal dimensions.

As in the embodiment shown in FIG. 7, the height is greater than that of the embodiment shown in FIG. 8, because the piezo elements 1, 1*a* with their rods 58, 58*a* sit on one side of the lever 59, 59*a* and the rods 2, 2*a* with the valves 9, 9*a* site on the other side of the lever 59, 59*a* . In FIG. 7, the height of the piezo elements 1, 1*a* with rods 58, 58*a* is represented with the numeral 74 and the height of the seating valves 9, 9*a* with the rods 2, 2*a* and the rotary lever 59, 59*a* is represented with the numeral 75. It is known that the overall height 74, 75 approximately double the total height 73 of the embodiment shown in FIG. 8.

According to the embodiment of FIGS. 6 and 13 through 17, both two-armed levers 33, 33*a* lie in a casing area 34, which is closed or encased by a casing cover 76. Both levers 33, 33*a* are arranged offset from one another and lie, respectively, at an acute angle to a longitudinal median plane 77 of the valve housing 5. In sideview, both levers 33, 33*a* lie in tandem, overlapping one another with a small distance. The axes of rotation 36, 36*a* lie parallel to one another. The rods 58, 58*a* of both piezo elements 1, 1*a* act upon the free end of the shorter lever arm. At the free end of the longer lever arm lie the rod s 2, 2*a* , with which the valve elements 3, 3*a* are operated in the described manner.

Figure 15:
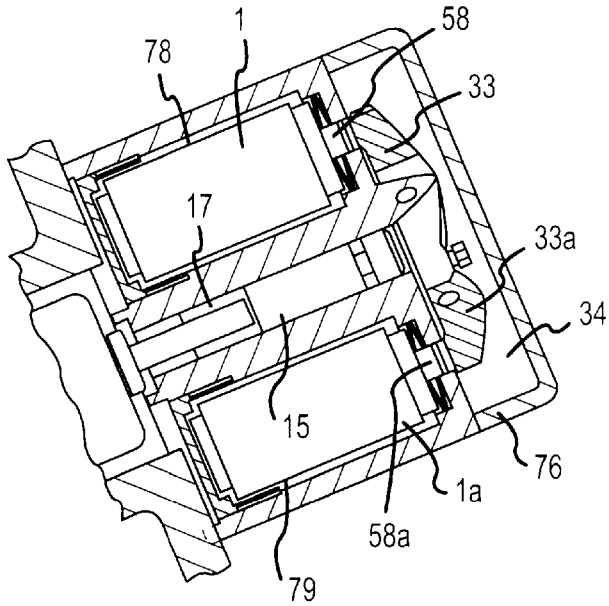
FIG. 15 shows a cut along the lines XV—XV in FIG. 13.

Both piezo elements 1, 1*a* line in separate casing areas 78, 79 (FIG. 15). The cylinder chamber or space 17 with the piston 15 is found in the area between both casing areas 78, 79. Through the ration of the lengths of the lever arms of the respective levers 33, 33*a* , the transmission radio is determined. In this manner, the minimal path of motion of the piezo-sided rods 58, 58*a* can be transmitted very simply in the required adjusted path of the rods 2, 2*a* , in order to reliably shift or displace the respective valve element 3, 3*a* with the required lift into the respective open or closed position.

The specification incorporates by reference the disclosure of German priority document 198 52 209.6 Nov. 12, 1998.

The present invention is, of course, in no way restricted to the specific disclosure of the specification and drawings, but also encompasses any modifications within the scope of the appended claims.

What is claimed is:

1. A valve control mechanism for intake and exhaust valves of internal combustion engines, comprising:

at least one piezo element;

at least one valve element, said valve element operated by said at least one piezo element;

at least one adjustment piston, wherein inflow and outflow of a pressure medium to said at least one adjustment piston is controlled by said at least one valve element, and wherein said at least one adjustment piston is moveable by said pressure medium, against counter pressure, for opening an intake or exhaust valve; and a pressure line for supplying said pressure medium, said pressure line connected to a pressure medium source, wherein said pressure line is connected to a surge chamber disposed in front of said adjustment piston when said valve element is in an open position, wherein said connection between said pressure line and said surge chamber is closed when said intake and exhaust valve is in a closed position, and wherein a tank line is simultaneously opened and the pressure medium is displaced through the adjustment piston into the tank line.

2. A valve control mechanism according to claim 1, wherein said valve element is a part of a seating valve which regulates the inflow of the pressure medium from said pressure line to said adjustment piston.

3. A valve control mechanism according to claim 2, wherein said seating valve is connectable to said surge chamber through a supply line, the surge chamber being delimited by the adjustment piston.

4. A valve control mechanism according to claim 3, wherein said supply line is joined with said tank line.

5. A valve control mechanism according to claim 4, wherein at least one of said supply line and said tank line is provided with a restrictor.

6. A valve control mechanism according to claim 1, wherein said adjustment piston, via a stem or rod, cooperates with a valve shaft of the intake or exhaust valve.

7. A valve control mechanism according to claim 6, wherein said valve shaft cooperates with the stem or rod via a cupping rod.

8. A valve control mechanism according to claim 3, wherein a cylinder area disposed opposite the surge chamber is connected to the atmosphere via a connection.

9. A valve control mechanism according to claim 4, wherein said supply line is connected to the tank line via at least one seating valve.

10. A valve control mechanism according to claim 4, wherein the movement of said adjustment piston is attenuated in at least one end position.

11. A valve control mechanism according to claim 10, wherein said adjustment piston includes in at least one front surface at least one pressure regulating valve cross-section, wherein said pressure regulating cross-section is a diametric recess.

12. A valve control mechanism according to claim 11, wherein said pressure regulating valve cross-section is associated with an annular channel in a mounting area of said adjustment piston.

13. A valve control mechanism according to claim 12, wherein said annular channel is connected to said tank line.

14. A valve control mechanism according to claim 12, wherein pressure in said surge chamber or an oppositely disposed cylinder space is built up through the crossing-over of a leading edge of said annular channel by said front surface of said adjustment piston, corresponding to the decreasing opening cross-section, wherein said pressure is directed counter to movement of said adjustment piston.

15. A valve control mechanism according to claim 14, wherein said surge chamber or said cylinder area is closed off from said tank line via a check valve.

16. A valve control mechanism according to claim 1, wherein a converter is provided between said piezo element and a stem which cooperates with said valve element.

17. A valve control mechanism according to claim 16, wherein said converter is a pivot lever.

18. A valve control mechanism according to claim 17, wherein said lever is of a two-arm construction.

19. A valve control mechanism according to claim 18, wherein said piezo element and said stem, on the same side, each engage an arm of said lever.

20. A valve control mechanism according to claim 17, wherein said lever is of a single-arm construction.

21. A valve control mechanism according to claim 20, wherein said piezo element and the rod engage opposite sides of said lever.

22. A valve control mechanism according to claim 1, wherein two piezo elements are provided, via which two seating valves are controllable.

23. A valve control mechanism according to claim 22, wherein said two seating valves are connected on a common supply line for pressure medium, said supply line emptying into said surge chamber.

24. A valve control mechanism according to claim 23, wherein when said piezo elements have no current, one of said seating valves is opened and the other seating valve is closed.

25. A valve control mechanism according to claim 24, wherein said valve element of said opened seating valve is adjustable to a closed position by means of a rod of one piezo element that is supplied with current, and wherein in said closed position a supply line is separated from said tank line.

26. A valve control mechanism according to claim 25, wherein said valve element of said closed seating valve is adjustable to its open position by means of a rod of the other piezo element when it is supplied with current, and wherein in said open position said pressure line is connected to said supply line which empties into said surge chamber.

27. A valve control mechanism according to claim 22, wherein said adjustment piston, and thereby the driven intake or exhaust valve, reaches its maximum lift, and can be maintained in that position, through a timed, sufficient current of both piezo elements.

28. A valve control mechanism according to claim 27, wherein both of said seating valves are closed to hold said adjustment piston in a maximum open-position.

29. A valve control mechanism according to claim 27, wherein one of said seating valves is closed and the other seating valve is opened to hold said adjustment piston in a maximum open-position.

30. A valve control mechanism according to claim 22, wherein through a timed, shortened current of both of said piezo elements, said adjustment piston reaches a smaller lift relative to a maximum lift.

31. A valve control mechanism according to claim 30, wherein to hold said adjustment piston at a decreased opening lift, both of said seating valves are closed.

32. A valve control mechanism according to claim 22, wherein both of said piezo elements work together with the rods by means of a respective converter, wherein said converter is a two-armed lever.

33. A valve control mechanism according to claim 32, wherein both of said converters, seen in the direction of their axes of rotation, are arranged to overlap one another.

34. A valve control mechanism according to claim 32, wherein both of said converters are disposed in series.

35. A valve control mechanism according to claim 32, wherein both of said converters are disposed parallel to one another.

36. A valve control mechanism according to claim 32, wherein both of said converters lie at an acute angle to a longitudinal median plane of a valve housing.

37. A valve control mechanism according to claim 2, wherein said seating valve is a two-way valve.

38. A valve control mechanism according to claim 1, wherein said valve element includes a seat portion, from which a cross-sectionally smaller shoulder projects.

39. A valve control mechanism according to claim 38, wherein said seat portion is partly ball-shaped or conical in construction.

40. A valve control mechanism according to claim 38, wherein a pressure spring is suspended on said shoulder of said valve element.

41. A valve control mechanism according to claim 38, wherein said shoulder extends from said seat portion in a conical construction.

42. A valve control mechanism according to claim 40, wherein a difference in the diameters of the shoulder and seat portion at the transition between the two corresponds to the doubled diameter of a wire of said pressure spring.

43. A valve control mechanism according to claim 38, wherein a wider seat portion is provided at a free end of said shoulder.

44. A valve control mechanism according to claim 43, wherein said wider seat portion is partly ball-shaped or conical in construction.

45. A valve control mechanism according to claim 43, wherein said wider seat portion has a smaller valve diameter than does said other seat portion.

46. A valve control mechanism according to claim 38, wherein said valve element is made out of a ball.

* * * * *